US007438589B1

(12) United States Patent
Fleury et al.

(10) Patent No.: US 7,438,589 B1
(45) Date of Patent: Oct. 21, 2008

(54) DUAL ENTRY CONNECTOR HAVING AN INTEGRATED POWER INDICATOR LIGHT

(75) Inventors: Philip J. Fleury, St. Francois Xavier (CA); Darrell Van Mol, Winnipeg (CA)

(73) Assignee: Phillips & Temro Industries Inc., Eden Prairie, MN (US)

( * ) Notice: Subject to any disclaimer, the term of this patent is extended or adjusted under 35 U.S.C. 154(b) by 0 days.

(21) Appl. No.: 11/888,898

(22) Filed: Aug. 2, 2007

(51) Int. Cl.
*H01R 13/66* (2006.01)

(52) U.S. Cl. ..... 439/490; 439/34

(58) Field of Classification Search ..... 439/34, 439/35, 488, 490
See application file for complete search history.

(56) References Cited

U.S. PATENT DOCUMENTS

| | | | | |
|---|---|---|---|---|
| 3,858,140 | A | 12/1974 | Hancock | |
| 4,538,134 | A | 8/1985 | Carey | |
| 4,570,145 | A | 2/1986 | Carey | |
| 4,699,445 | A | 10/1987 | Porta et al. | |
| 5,088,835 | A | 2/1992 | Shigezawa et al. | |
| 5,116,232 | A * | 5/1992 | Follett | 439/107 |
| 5,181,866 | A | 1/1993 | Jerome et al. | |
| 5,188,542 | A | 2/1993 | Ballman | |
| 5,320,563 | A | 6/1994 | Liao | |
| 5,384,559 | A | 1/1995 | Shamir | |
| 5,470,252 | A * | 11/1995 | Fladung | 439/490 |
| 5,538,439 | A | 7/1996 | Fell et al. | |
| 5,590,010 | A | 12/1996 | Ceola et al. | |
| 5,742,464 | A | 4/1998 | Ceola et al. | |
| 5,777,868 | A | 7/1998 | Gibboney, Jr. | |
| 5,885,098 | A | 3/1999 | Witkowski | |
| 5,930,097 | A | 7/1999 | Ceola et al. | |
| 5,937,140 | A | 8/1999 | Leonard et al. | |
| 6,036,530 | A | 3/2000 | Edwards et al. | |
| 6,039,602 | A | 3/2000 | Witkowski et al. | |
| 6,048,219 | A * | 4/2000 | Kotowski | 439/221 |
| 6,072,152 | A | 6/2000 | Landry | |
| 6,171,118 | B1 | 1/2001 | Witkowski et al. | |

(Continued)

FOREIGN PATENT DOCUMENTS

| | | |
|---|---|---|
| CA | 2135948 | 5/1996 |

OTHER PUBLICATIONS

Photograph of KIM Hotstart TV Connector, Part No. 80505-3407.

(Continued)

*Primary Examiner*—James Harvey
(74) *Attorney, Agent, or Firm*—Harness, Dickey & Pierce, P.L.C.

(57) ABSTRACT

An electrical connector system for use with an electrically powered accessory mounted to a vehicle is disclosed. The electrical connector system includes a connector adapted to be mounted to the vehicle as well as a cord having a first end adapted to be electrically coupled to the accessory and a second end having a plug. The plug is adapted to be electrically coupled to a power source remote from the vehicle, is removably coupled to the connector and includes a flexible finger having a tab engaging the connector. The electrical connector system also includes an indicator mounted to the connector and in electrical communication with the plug. The indicator is operable to provide a visual indication when electrical power is present at the plug.

20 Claims, 6 Drawing Sheets

U.S. PATENT DOCUMENTS

| | | | | |
|---|---|---|---|---|
| 6,179,654 | B1 | 1/2001 | Witkowski et al. | |
| 6,257,923 | B1 | 7/2001 | Stone et al. | |
| 6,448,863 | B1 | 9/2002 | Ogawa et al. | |
| 6,644,987 | B2 | 11/2003 | Meleck | |
| 6,975,242 | B2 * | 12/2005 | Dannenmann et al. | 340/815.45 |
| 7,285,007 | B2 * | 10/2007 | Barna | 439/490 |
| 7,378,756 | B2 * | 5/2008 | Singer et al. | 307/64 |
| 2003/0100218 | A1 * | 5/2003 | Tsai et al. | 439/490 |

OTHER PUBLICATIONS

Photograph of KIM Hotstart TV Connector (View A).
Photograph of KIM Hotstart TV Connector (View B).
Trace Engineering Receptacle; (4) pictures, date taken Dec. 8, 2000.
Trace Engineering Aftermarket Truck Inverter Installation Kits, publication date unknown, 2 pages.

* cited by examiner

DUAL ENTRY CONNECTOR HAVING AN INTEGRATED POWER INDICATOR LIGHT

BACKGROUND AND SUMMARY

The present disclosure relates generally to electrically powered accessories for motor vehicles and, more particularly, to an electrical connector and indicator system for motor vehicles.

Various electrically powered devices are designed for use with vehicles including automobiles, light-duty trucks and heavy-duty vehicles. The electrically powered devices include cold weather starting aids such as radiant heaters, engine block heaters, fluid heaters, battery warmers, and the like, and may be generally fixed to the automobile and operationally connected to an appropriate component of the vehicle engine. The operation of these devices generally occurs upon connection to a power source external to the vehicle. As such, a factor in the sales and use of these devices may be the simplicity with which the device can be electrically connected to the power source. To address this concern, cord sets have been developed that include a receptacle connected to the vehicle body for mounting an electrical cord that is connected to the electrically powered device. The power cords of the cord sets terminate at a male or female plug that is coupled to the receptacle. A counterpart plug external to the vehicle is selectively coupled to the receptacle to allow electrical connection of the device to the power source.

Cord sets for selectively electrically connecting an electrically powered automobile accessory to a power source are commercially available for use with heavy-duty vehicles today. Specifically, the assignee of the present disclosure and others have manufactured cord set receptacles that are generally cylindrical in shape and include a cylindrical housing open at one end to accommodate a male plug. The cylindrical housing may be normally closed at an opposite end by a spring biased cover.

The present disclosure relates to an electrical connector system for use with an electrically powered accessory mounted to a vehicle. The electrical connector system includes a connector adapted to be mounted to the vehicle as well as a cord having a first end adapted to be electrically coupled to the accessory and a second end having a plug. The plug is adapted to be electrically coupled to a power source remote from the vehicle, is removably coupled to the connector and includes a flexible finger having a tab engaging the connector. The electrical connector system also includes an indicator mounted to the connector and in electrical communication with the plug. The indicator is operable to provide a visual indication when electrical power is present at the plug.

Furthermore, an electrical connector system for use with an accessory mounted to a vehicle is disclosed. The electrical connector system includes a connector having first and second housings integrally formed with a plate. First and second plugs are adapted to be electrically coupled to a power source remote from the vehicle and removably coupled to the first and second housings, respectively. An indicator in electrical communication with the first plug is adapted to be mounted to the connector at a visible location and is operable to provide a visual indication when electrical power is present at the plug.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the disclosure, its application, or uses.

Figure 1:
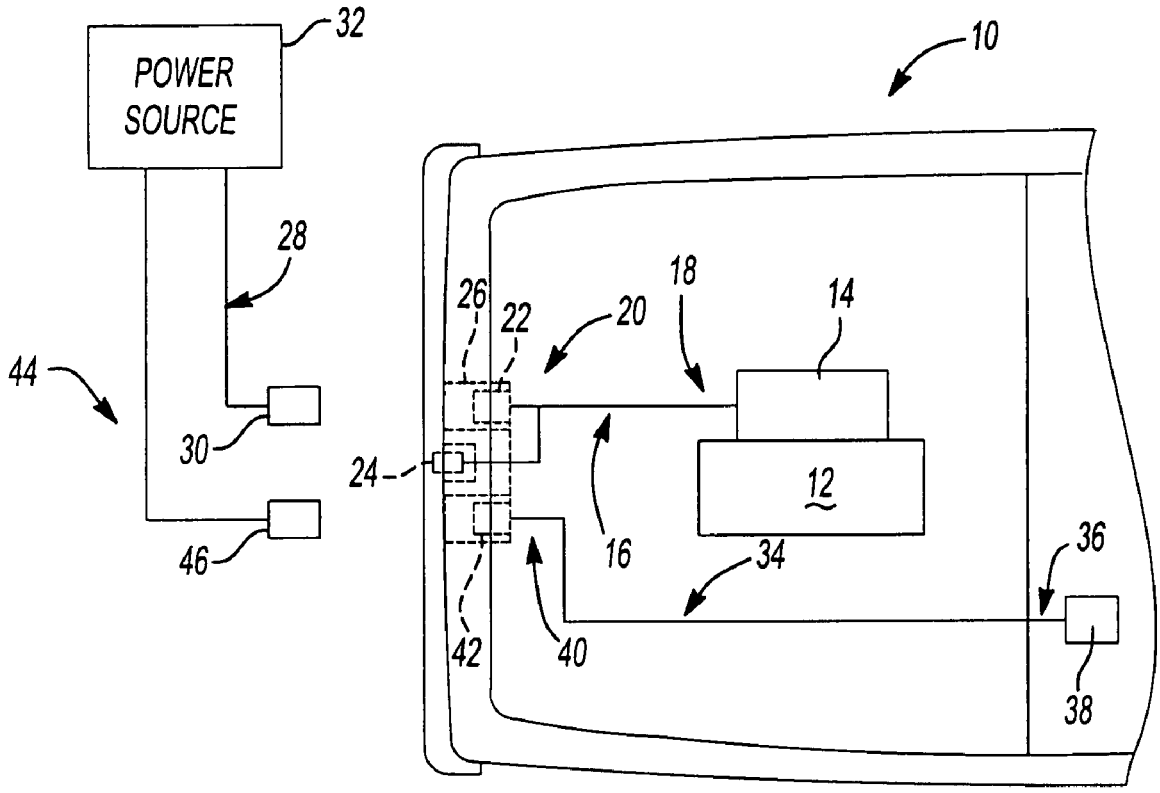
FIG. 1 is a schematic illustration of an exemplary vehicle equipped with an electrical connector system.
Figure 2:
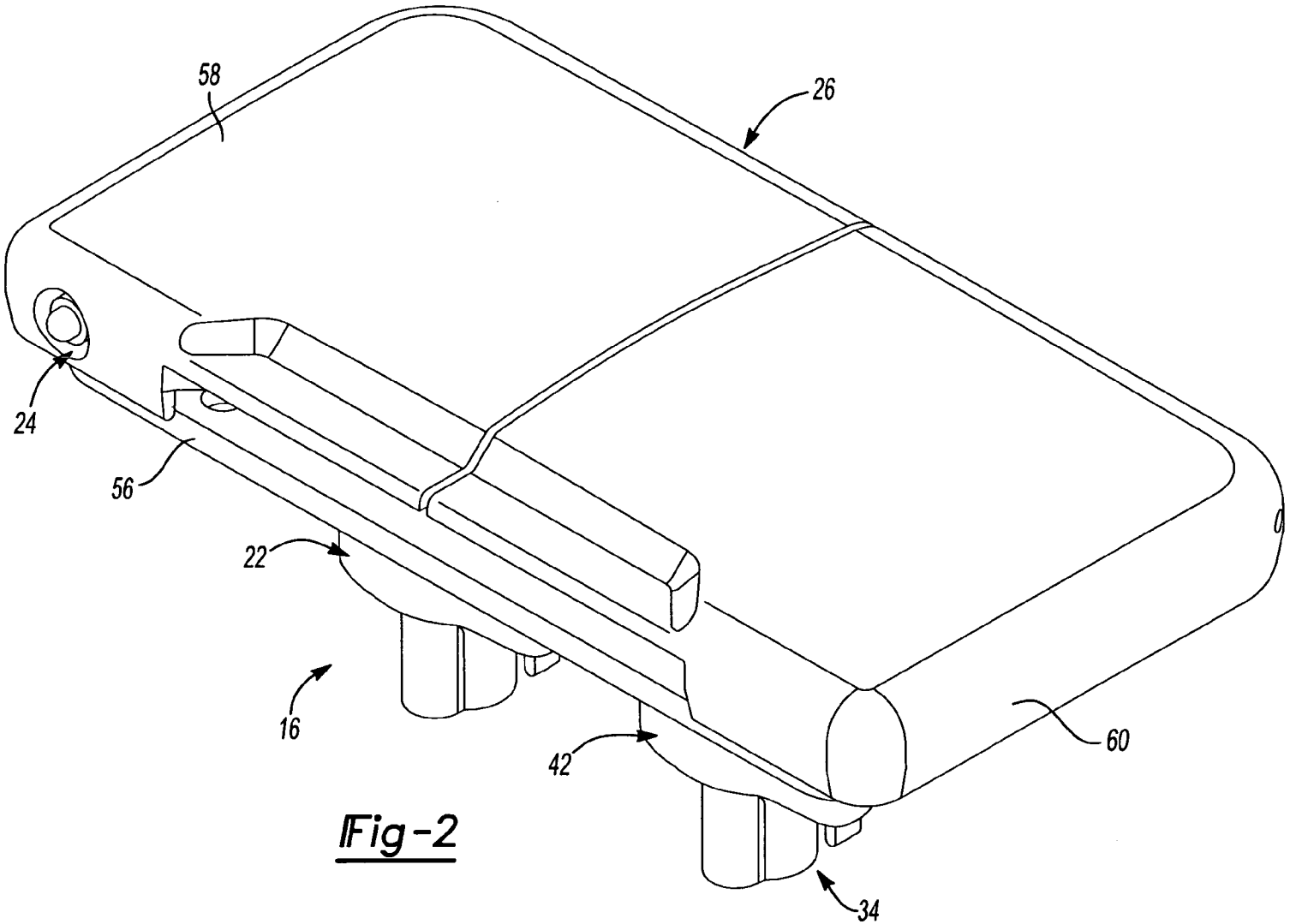
FIG. 2 is a perspective view of an electrical connector system.
Figure 3:
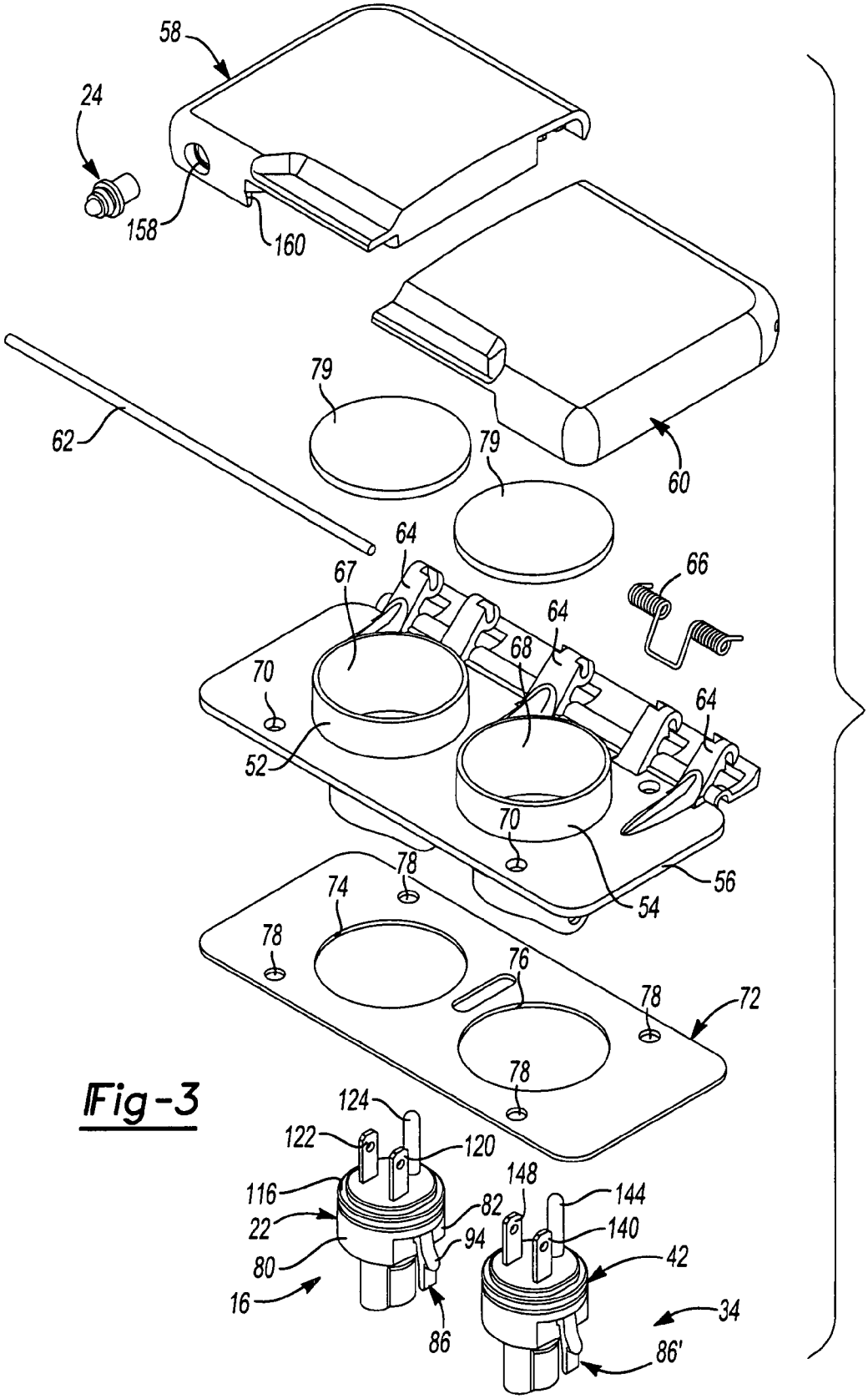
FIG. 3 is an exploded perspective view of the electrical connector system.
Figure 4:
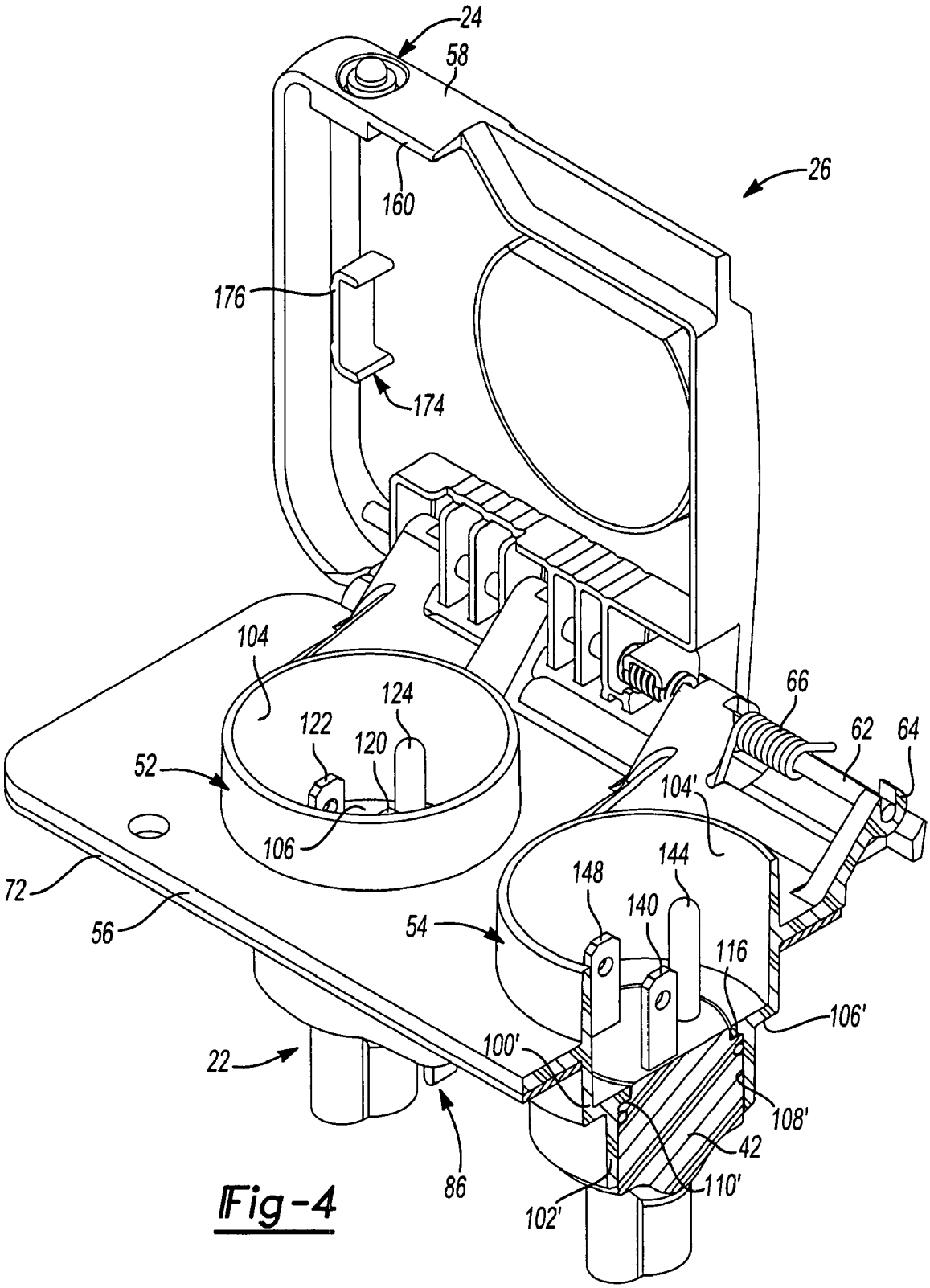
FIG. 4 is a fragmentary perspective view showing the electrical connector system.

FIG. 1 depicts a vehicle 10 including an engine 12 and a powered automobile accessory 14, such as an engine block heater. A first cord set 16 has a first end 18 electrically connected to the accessory 14 and a second bifurcated end 20. One portion of bifurcated end 20 terminates at a plug 22. The other end terminates at an indicator 24. Plug 22 is coupled to a dual entry connector 26 that is mounted to the vehicle 10. An auxiliary cord 28 includes a plug 30 for selectively interconnecting first cord set 16 to an external power source 32 via plug 22. The power source 32 includes an alternating current electrical outlet such as those generally mounted in the walls of building structures or at "shore stations" for vehicles.

A second cord set 34 has a first end 36 connected to a cab power system 38. Cab power system 38 may include a number of alternating current outlets located within the cabin of vehicle 10 to allow a user to power common household accessories such as video monitors and DVD players positioned within the vehicle cabin. A second end 40 of second cord set 34 terminates at a plug 42. Plug 42 is also coupled to dual entry connector 26. An auxiliary cord 44 includes a plug 46 for selectively interconnecting second cord set 34 to power source 32 via plug 42. Power source 32 provides alternating current for use in cab power system 38. It should be appreciated that auxiliary cord 28 may be used in cooperation with plug 42 instead of auxiliary cord 44. In use, zero, one or two auxiliary cords may be coupled to dual entry connector 26 depending on the electrical needs of the user.

FIGS. 2-6 depict dual entry connector 26 in communication with first cord set 16 and second cord set 34. Dual entry connector 26 includes first and second substantially cylindrically-shaped hollow housings 52, 54 integrally formed with a plate 56. First and second covers 58, 60 are rotatably coupled to plate 56 via a hinge pin 62. Hinge pin 62 is supported by multiple stanchions 64 integrally formed with and extending from plate 56. A spring 66 biases first and second covers 58, 60 toward closed positions depicted in FIG. 2. First and second covers 58, 60 are selectively moveable to opened positions (FIG. 4) rotated about hinge pin 62 ninety degrees or more to allow access to first and second cavities 67, 68 formed within housings 52, 54, respectively.

Plate 56 includes a plurality of apertures 70 sized for receipt of fasteners (not shown). A gasket 72 is constructed from a resilient material and is operable to form a seal between plate 56 and a panel of exemplary vehicle 10. Gasket 72 includes apertures 74, 76 sized to allow housings 52, 54 to pass therethrough. Gasket 72 also includes additional apertures 78 sized and positioned to accept the fasteners extending through apertures 70.

Seals 79 are coupled to first and second covers 58, 60 to selectively engage housings 52, 54 to seal off cavities 67 and 68. Mechanical connections are made to couple plugs 22 and 42 to dual entry connector 26. Plugs 22 and 42 are coupled to housings 52, 54 in substantially the same manner. Accordingly, only one connection will be described in detail. Plug 22 includes a substantially cylindrically shaped body 80 having flats 82 and 84 formed thereon. Flats 82, 84 extend substantially parallel to one another on opposite sides of body 80. First and second fingers 86, 88 are integrally formed with body 80 and longitudinally extend from flats 82, 84, respectively. Each of the fingers 86, 88 includes a first end 90 fixed to body 80 and a second end 92 cantilevered and spaced apart from body 80. Fingers 86, 88 are preferably constructed from an elastomeric material that allows each finger to be deflected upon receipt of a force. When the force is removed, the fingers return to the unbiased positions shown in FIG. 5. A tab 94 radially outwardly extends from each of fingers 86, 88. By applying a force to free end 92, finger 86 may be deflected to vary the radial position of tab 94. Tab 94 includes an angled surface 96 and a partial cylindrical surface 98.

First housing 52 and second housing 54 are substantially similar to one another. Accordingly, like reference numerals including prime suffixes are shown to represent like elements. For clarity, only first housing 52 will be described in detail. First housing 52 includes a first cylindrically shaped portion 100 and a second cylindrically shaped portion 102. Cylindrically shaped portion 100 includes an inner cylindrical surface 104 sized to receive plug 30 of auxiliary cord 28. Cylindrical portion 100 terminates at an end wall 106. Second cylindrical portion 102 extends from end wall 106 in a direction opposite from cylindrically shaped portion 100 and includes an inner cylindrical surface 108 having a diameter smaller than inner cylindrical surface 104. A land 110 radially inwardly extends from inner cylindrical surface 108 and acts as a stop to limit axial travel of plug 22 relative to dual entry connector 26. Second cylindrical portion 102 includes first and second transversely oriented apertures 112, 114 sized to receive tabs 94. Apertures 112 and 114 may be coaxially aligned with one another.

In the undeformed state shown in the Figures, tabs 94 radially outwardly extend a distance greater than the diameter defined by inner cylindrical surface 108. To couple plug 22 to dual entry connector 26, a user axially displaces plug 22 into second cylindrically shaped portion 102 of housing 52. During axial translation, angled surfaces 96 engage inner cylindrical surface 108 causing fingers 86, 88 to radially inwardly deflect. Deflection of fingers 86, 88 allows plug 22 to continue to enter second cylindrically shaped portion 102. As tabs 94 enter apertures 112, 114, fingers 86, 88 spring back to their undeformed state. Further axial travel of plug 22 in the insertion direction is limited by an end face 116 of plug 22 engaging land 110. Once tabs 94 are positioned within apertures 112, 114, axial travel of plug 22 in a direction attempting to separate plug 22 from dual entry connector 26 will be resisted by cylindrical surface 98 in engagement with the wall of apertures 112, 114.

If disconnection of first cord set 16 from dual entry connector 26 is desired, a user applies force to ends 92 of fingers 86, 88 to radially inwardly deflect tabs 94. Once tabs 94 are clear of second cylindrical portion 102, a user may axially move plug 22 relative to dual entry connector 26.

Plug 22 includes a male live terminal 120, a male neutral terminal 122, and a male ground terminal 124. Each of the terminals 120, 122 and 124 is electrically coupled to a wire. In particular, ground terminal 124 electrically conducts with a ground wire 126. Live terminal 120 is electrically and mechanically coupled to a supply wire 128. Live terminal 120 is also electrically coupled to a first lead wire 129 of indicator 24. A resistor (not shown) may be placed in series between live terminal 120 and indicator 24 as desired.

A neutral wire 130 is electrically coupled to neutral terminal 122. A second lead wire 132 of indicator 24 is electrically coupled to neutral wire 130. A first signal may be emitted from indicator 24 when power source 32 is electrically coupled to terminals 120, 122 and 124. Depending on the particular indicator wiring, indicator 24 may be a single color or a dual color light-emitting-diode (LED). If a dual color LED is implemented a circuit may be constructed such that the first signal corresponds to the LED emitting a green light. If current is flowing through plug 22 such as when accessory 14 is operating, a second signal is emitted from indicator 24. The second signal is a red light emitted from the LED.

Alternatively, the first signal may be a constantly illuminated lamp or LED. The second signal from indicator 24 may be a flashing light. One skilled in the art will appreciate that any number of different visual indications may be emitted from a single indicator 24. The various other signals are intended to be within the scope of the disclosure.

Plug 42 also includes a plurality of terminals electrically coupled to wires. Specifically, plug 42 includes a male live terminal 140 electrically coupled to a supply wire 142. A ground terminal 144 electrically conducts with a ground wire 146. A neutral terminal 148 is electrically coupled with a neutral wire 149. In the embodiment shown, each of terminals 140, 144 and 148 are shaped as male terminals. It is contemplated that female terminals and/or a combination of male and female terminals may be utilized without departing from the scope of the present disclosure. Plug 42 is substantially similar to plug 22. As such, like reference numerals having prime suffixes have been used to depict like elements.

Indicator 24 may be secured to first cover 58 with a threaded housing 150 and a nut 152. Housing 150 includes a substantially cylindrically-shaped hollow portion 154 and a radially enlarged portion 156. Nut 152 includes an internal thread threadingly engaging an external thread of portion 154 on threaded housing 150. Nut 152 is positioned within a pocket 158 formed on a downstanding flange 160 of first cover 58. Portion 154 extends through an aperture 162 extending through flange 160. Indicator 24 is positioned at the end of threaded housing 150 such that first and second lead wires 129 and 132 extend through housing 150 while a lamp portion 164 of indicator 24 protrudes outwardly from the end of threaded housing 150. Nut 152 secures indicator 24 to panel first cover 58 and positions lamp portion 164 to slightly protrude beyond nut 152. It should be appreciated that the mounting arrangement and positioning of indicator 24 relative to dual entry connector 26 is merely exemplary and that it is contemplated that indicator 24 may be mounted in any number of locations on external surfaces of the vehicle or within the passenger cabin.

Figure 5:
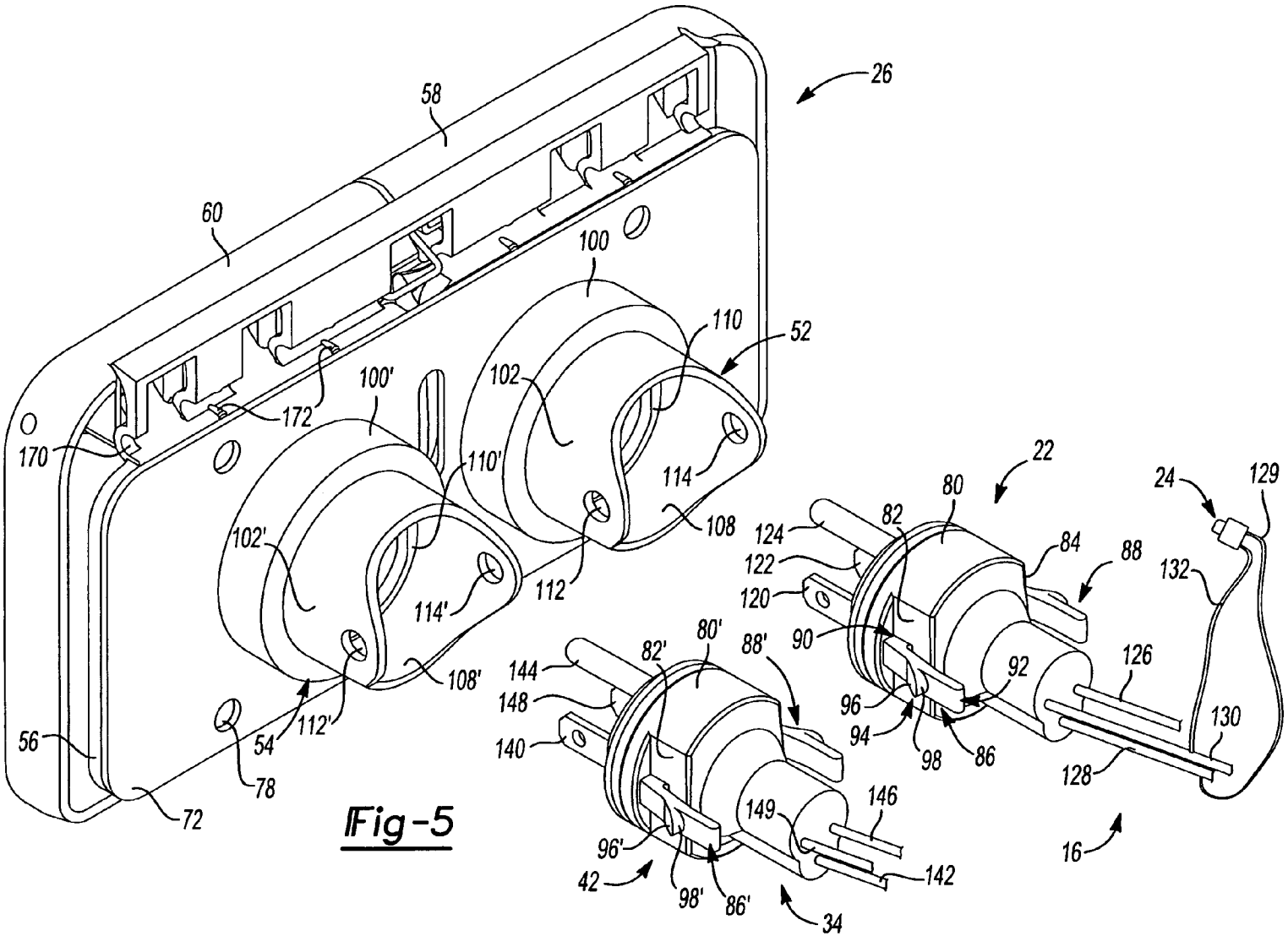
FIG. 5 is another fragmentary perspective view of the electrical indicator system.
Figure 6:
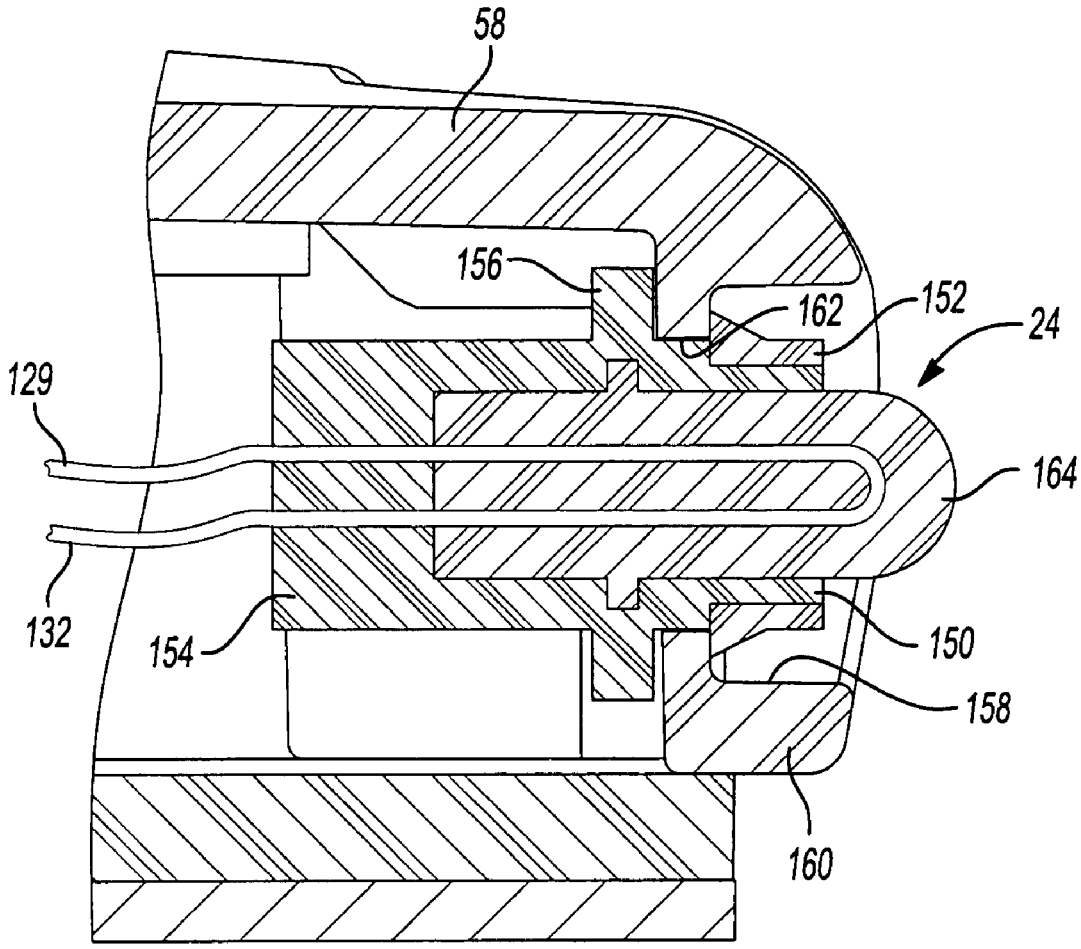
FIG. 6 is a fragmentary sectional view of a visual indicator of the electrical connector system.

A wire trough 170 (FIG. 5) is integrally formed with plate 56 and stanchions 64 as shown in FIG. 5. Pairs of crimps 172 define local reduced diameter portions of wire trough 170. Crimps 172 assist to retain lead wires 129 and 132 in trough 170. A wire clip 174 and crimps 176 may be formed on first cover 58 to maintain a desired position of lead wires 129 and 132 adjacent to or in engagement with an inner surface of first cover 58. It should be appreciated that downstanding flange

160 of first cover 58 may be positioned to extend substantially parallel to the ground. While first cover 58 is in the closed position, indicator 24 faces the ground. However, when an operator opens first cover 58 and electrically couples power source 32 to plug 22, indicator 24 will be facing the operator and may be easily viewed.

Furthermore, the foregoing discussion discloses and describes merely exemplary embodiments of the present disclosure. One skilled in the art will readily recognize from such discussion, and from the accompanying drawings and claims, that various changes, modifications and variations may be made therein without department from the spirit and scope of the disclosure as defined in the following claims.

What is claimed is:

1. An electrical connector system for use with an electrically powered accessory mounted to a vehicle, the connector system comprising:

a connector adapted to be mounted to the vehicle;

a cord having a first end adapted to be electrically coupled to the accessory and a second end having a plug, the plug being adapted to be electrically coupled to a power source remote from the vehicle, the plug being removably coupled to the connector and including a flexible finger having a tab engaging the connector; and an indicator being mounted to the connector and in electrical communication with the plug, the indicator being operable to provide a visual indication when electrical power is present at the plug.

2. The electrical connector system of claim 1 wherein the connector includes a plate portion integrally formed with a first housing portion, the tab engaging an aperture formed in the first housing portion.

3. The electrical connector system of claim 2 wherein the flexible finger deflects from an unbiased position to a biased position and returns to the unbiased position during interconnection of the plug and the first housing.

4. The electrical connector system of claim 3 wherein a portion of the flexible finger is encompassed by the first housing and another portion of the flexible finger extends beyond an end of the first housing when the plug is coupled to the first housing.

5. The electrical connector system of claim 1 wherein the connector includes a first pivotally moveable cover enclosing a cavity containing the plug.

6. The electrical connector system of claim 5 wherein the indicator is fixed to the cover.

7. The electrical connector system of claim 6 wherein the connector includes a second pivotally moveable cover positioned adjacent to the first cover.

8. The electrical connector system of claim 7 wherein the second cover encloses another cavity containing another plug.

9. The electrical connector system of claim 8 wherein the another plug is coupled to another cord adapted to provide power to a vehicle cabin.

10. The electrical connector system of claim 2 wherein the first housing portion includes a substantially cylindrically-shaped wall portion protruding from each of a first surface of the plate portion as well as a second opposite surface of the plate portion.

11. The electrical connector system of claim 1 wherein the tab is disengageable from the connector by application of a biasing force to the flexible finger.

12. The electrical connector system of claim 1 wherein the plug includes another flexible finger spaced apart from the flexible finger and having another tab engaging the connector.

13. An electrical connector system for use with an accessory mounted to a vehicle, the connector system comprising:

a connector having first and second housings integrally formed with a plate;

first and second plugs adapted to be electrically coupled to a power source remote from the vehicle and removably coupled to the first and second housings, respectively; and an indicator in electrical communication with the first plug, the indicator being adapted to be mounted to the connector at a visible location, the indicator being operable to provide a visual indication when electrical power is present at the first plug.

14. The electrical connector system of claim 13 further including a first cord having a bifurcated first end terminating at the first plug and at the indicator, the first cord having a second end adapted to be electrically coupled to the accessory.

15. The electrical connector system of claim 14 further including a second cord having a first end terminating at the second plug and a second end adapted to be electrically coupled to the vehicle cabin.

16. The electrical connector system of claim 13 wherein the first plug includes a first flexible finger deflectable from an unbiased position to a biased position, the first flexible finger being in the unbiased position when the first plug is coupled to the first housing.

17. The electrical connector system of claim 16 wherein the first flexible finger includes a radially outwardly extending first tab positioned within an aperture extending through a sidewall of the first housing when the first plug is coupled to the first housing.

18. The electrical connector system of claim 17 wherein the first plug further includes a second flexible finger having a radially outwardly extending second tab, wherein the first and second tabs are spaced apart a distance greater than an inner diameter of the first housing.

19. The electrical connector system of claim 18 wherein each of the first and second tabs include inclined surfaces that engage the first housing to cause the first and second flexible fingers to deflect during insertion of the first plug into the first housing.

20. The electrical connector system of claim 13 wherein the first housing includes a radially inwardly extending wall in engagement with the first plug to limit the axial distance the plug is allowed to enter the first housing.

* * * * *